US007096558B2

(12) United States Patent
Sano

(10) Patent No.: US 7,096,558 B2
(45) Date of Patent: Aug. 29, 2006

(54) METHOD OF MANUFACTURING GOLF CLUB HEAD

(75) Inventor: Yoshinori Sano, Kobe (JP)

(73) Assignee: SRI Sports Limited, Kobe (JP)

( * ) Notice: Subject to any disclaimer, the term of this patent is extended or adjusted under 35 U.S.C. 154(b) by 149 days.

(21) Appl. No.: 10/843,336

(22) Filed: May 12, 2004

(65) Prior Publication Data

US 2004/0226160 A1 Nov. 18, 2004

(30) Foreign Application Priority Data

May 16, 2003 (JP) ..... 2003-139235

(51) Int. Cl.
*A63B 53/04* (2006.01)

(52) U.S. Cl. ..... 29/428; 29/34 R; 29/527.5; 72/342.5; 473/282; 473/324; 473/325

(58) Field of Classification Search ..... 29/527.5, 29/428, 34 R, DIG. 18; 72/342.5; 473/282, 473/324, 325, 345, 349, 342, 409
See application file for complete search history.

(56) References Cited

U.S. PATENT DOCUMENTS 4,975,125 A * 12/1990 Chakrabarti et al. ..... 148/407
5,509,933 A * 4/1996 Davidson et al. ..... 623/23.53
5,885,375 A * 3/1999 Takemura et al. ..... 148/421
6,814,820 B1 * 11/2004 Ozbaysal ..... 148/671
6,926,616 B1 * 8/2005 Kusumoto et al. ..... 473/305
6,932,719 B1 * 8/2005 Yabu ..... 473/345

FOREIGN PATENT DOCUMENTS

JP 2001-288518 A 10/2001

* cited by examiner

*Primary Examiner*—George Nguyen
*Assistant Examiner*—Christopher K. Agrawal

(74) *Attorney, Agent, or Firm*—Birch, Stewart, Kolasch & Birch, LLP

(57) ABSTRACT

A method of manufacturing a golf club head comprises: hot forging a material of a beta titanium alloy into the face plate, slow cooling the forged face plate; and assembling a golf club head from the face plate and other component(s).

10 Claims, 1 Drawing Sheet

METHOD OF MANUFACTURING GOLF CLUB HEAD

This Non-provisional application claims priority under 35 U.S.C. § 119(a) on Patent Application No(s). 2003-139233 filed in Japan on May 16, 2003, the entire contents of which are hereby incorporated by reference.

BACKGROUND OF THE INVENTION

The present invention relates to a method of manufacturing a golf club head, more particularly to a process of forming a face portion which can improve its durability and the rebound performance of the head.

In order to improve the rebound performance of golf club heads, it is widely employed in wood-type golf club heads in particular to decrease the thickness of the face portion. Such thinning of the face portion decreases the fatigue strength against repetition of impulsive force at the time of hitting a ball. Therefore, as a best suited material having an excellent fatigue strength, beta titanium alloys get a lot of attention.

In general, beta titanium alloys are not bad in workability in cold work. However, in case of a face plate having elaborate geometry, hot forging at over the solid solution temperature and subsequent quenching by water-cooling are usually employed to make the face plate for the working efficiency and accuracy.

It is believed in the art that if heating time of beta titanium alloy is increased, coarsening of beta phase is caused and thereby the strength and toughness are decreased. For this reason, therefore, quenching is employed after the hot forging.

With respect to some of beta titanium alloys, however, the inventor found that fatigue strength is remarkably improved, contrary to expectation, by slow cooling the alloy after hot forging, and thereby the durability of the face plate is remarkably improved because the improvement in the fatigue strength advantageously affects the durability rather than improvement in the tensile strength.

SUMMARY OF THE INVENTION

It is therefore, an object of the present invention to provide a method of manufacturing a golf club head by which the rebound performance and durability of the face portion can be improved.

According to one aspect of the present invention, a method of manufacturing a golf club head comprises: hot forging a material of a beta titanium alloy into the face plate, slow cooling the forged face plate; and assembling a golf club head from the face plate and other component(s).

BRIEF DESCRIPTION OF THE DRAWING(S)

DESCRIPTION OF THE PREFERRED EMBODIMENT(S)

Figure 1:
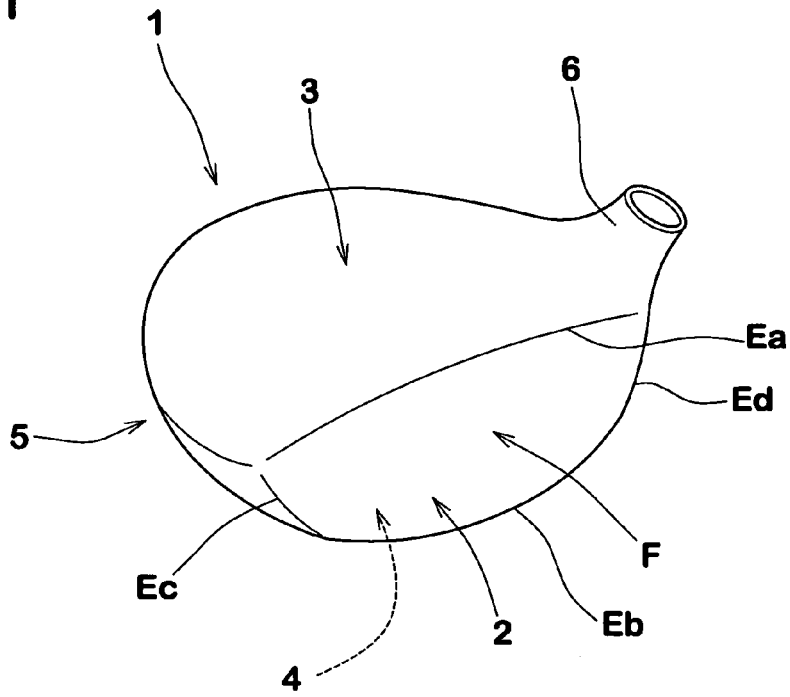
FIG. 1 is a perspective view of a wood-type golf club head according to the present invention.

An embodiment of the present invention will now be described in detail in conjunction with the accompanying drawings.

In the drawings, golf club head 1 according to present invention is a metal wood-type hollow head comprising: a face portion 2 whose front face defines a club face F for striking a ball; a crown portion 3 intersecting the club face F at the upper edge Ea thereof; a sole portion 4 intersecting the club face F at the lower edge Eb thereof; a side portion 5 between the crown portion 3 and sole portion 4 which extends from a toe-side edge Ec to a heel-side edge Ed of the club face F through the back side of the club head; and a hosel neck portion 6 to be attached to an end of a club shaft (not shown).

The club head 1 is made up of at least two parts: a face plate 1A and a head main body 1B. The face plate 1A is a single metal part. The head main body 1B is also a single metal part in this embodiment, but it may be an assembly of two or more parts. In this embodiment, as shown in FIG. 2, the head has a two-piece structure-, and the face plate 1A is welded to the head main body 1B.

The face plate 1A is to form a major part (in this example, the entirety) of the club face F. The face plate 1A is further provided with a turnback 12 at the edge E (generic expression of Ea, Eb, Ec and Ed) of the face portion 2.

The turnback 12 extends backwards to form part of the crown portion 3, sole portion 4 and side portion 5, and its size L is in a range of from 5 to 30 mm when measured horizontally in the back-and-force direction between the rear end thereof and the above-mentioned edge E. Accordingly, the head main body 1B is made up of the above-mentioned hosel neck portion 6 and the remaining part of the crown portion 3, sole portion 4 and side portion 5. In this example, the turnback 12 is formed along the almost overall length of the edge E excepting a part corresponding the hosel neck portion 6. More specifically, the turnback 12 includes: a crown-side turnback 12*a* forming a front end zone of the crown portion 3; a sole-side turnback 12*b* forming a front end zone of the sole portion 4; a toe-side turnback 12*c* forming a front end zone of the toe-side part of the side portion 5; and a heel-side turnback 12*d* forming a front end zone of the heel-side part of the side portion 5. The above-mentioned remaining part is thus a major part 13 of the crown portion 3, a major part 14 of the sole portion 4 and a major part 15 of the side portion 5, and an opening (O) which is closed with the face plate 1A is formed in the front of the head main body 1B.

Figure 2:
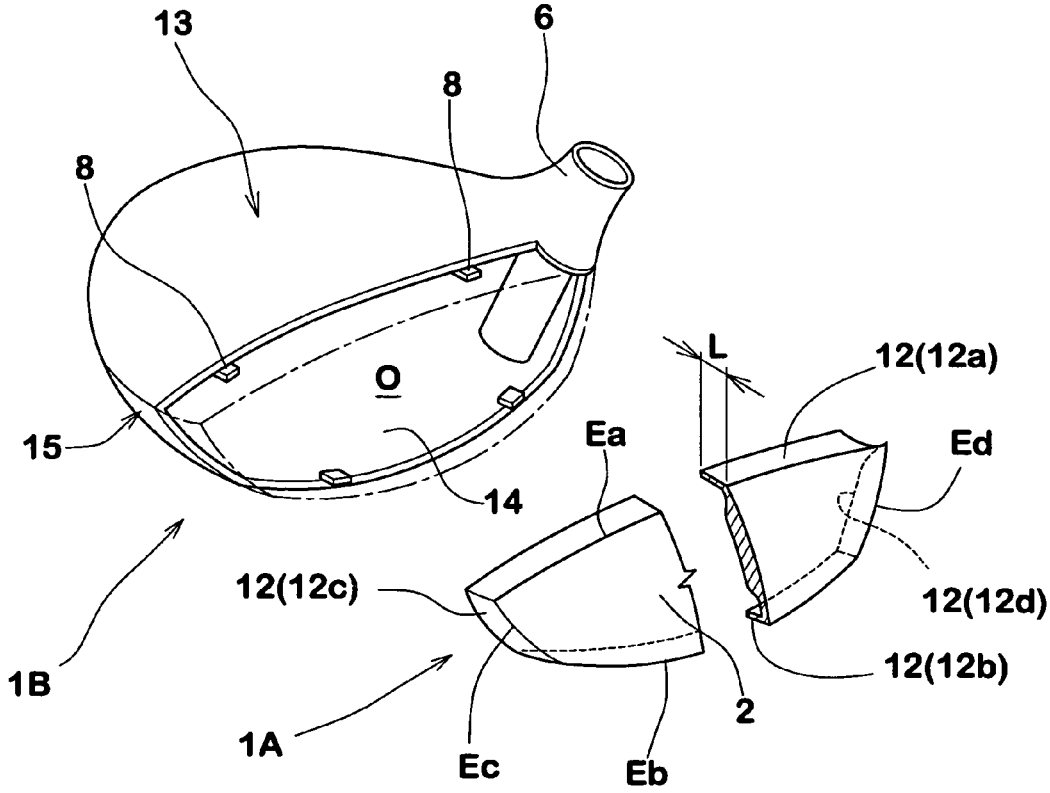
FIG. 2 is an exploded view thereof showing an example of two piece structure.

As shown in FIG. 2, the head main body 1B is provided along the edge of the opening (O) with catches 8 for locating the face plate accurately during welding while forming a small gap therebetween to be bridged with a weld metal.

As for the material of the head main body 1B, various metal materials, e.g. titanium alloys, pure titanium, aluminum alloys, stainless steel and the like may be used.

In this embodiment, as the face plate 1A is welded to the head main body 1B, a weldable material, specifically an alpha-beta titanium alloy Ti-6Al-4V is used, and the head main body 1B is integrally molded, using a lost-wax precision casting method.

On the other hand, the face plate 1A is made of a beta titanium alloy having a single phase of beta at room temperature. For example, Ti-15V-3Cr-3Al-3Sn, Ti-22V-4Al, Ti-15Mo-5Zr-3Al, Ti-15V-6Cr-4Ti-13V-11Cr-3Al, Ti-8Mo-8V-2Fe-3Al, Ti-3Al-8V-6Cu-4Mo-4Zr, Ti-11.5Mo-6Zr-4.5Sn, Ti-15Mo-5Zr and the like may be used. Preferably, Ti-15V-6Cr-4Al and Ti-15Mo-5Zr-3Al are used because these two alloys are remarkably improved in the fatigue strength by slow cooling. Incidentally, the number of each element indicating its percentage by mass is a nominal value. In other words, a certain degree of variations for example +−0.2 to +−0.5 are permitted and the number must be considered as the center value of the variation. In case of Ti-15V-6Cr-4Al for example, the following variations may be involved: v is 14.5 to 15.5%; Cr is 5.8 to 6.2%; Al is 3.8 to 4.2%. The remainder is Ti and a very small amount of inevitable impurities (such as Fe and O).

The beta titanium alloy in a shape of ingot for example, is cut into an appropriate shape for example a plate, a round bar or the like, and then the alloy is formed into a shape of the face plate 1A by hot forging.

In order to improve the rebound performance, the maximum thickness of the face plate 1A is preferably decreased into a range of not more than 2.7 mm, more preferably not more than 2.5 mm, but in order to secure the necessary strength and durability, it is preferred that the maximum thickness is not less than 2.0 mm, more preferably not less than 2.2 mm.

Here, the hot forging means a process of forming the material into a specific shape utilizing its compressive plastic deformation caused by hammering and/or pressing while heating up the material to a specific temperature. For example, so called free forging, open die forging, closed die forging, semi-closed die forging, high-speed forging, isothermal forging and the like are included. But, metal rolling is not included.

If the forging temperature is less than 800 deg. C., workability is decreased to lower the dimensional stability of the face plate 1A with the turnback 12 in particular. Further, fatigue and wear of the die increase. If the forging temperature is more than 950 deg. C., coarsening of beta phase increases rapidly, and the strength and toughness are decreased.

Therefore, the forging should be made in a temperature range of not less than 800 deg. C., preferably more than 830 deg. C., more preferably more than 840 deg. C., but not more than 950 deg. C., preferably less than 900 deg. C., more preferably less than 880 deg. C.

In order to rise the internal temperature of the alloy thoroughly and uniformly up to this temperature range, it is preferable that the forging is started after the beta titanium alloy is kept in the above-mentioned temperature range for a time period of from 5 to 60 minutes.

After the alloy is formed into the shape of the face plate 1A through the hot forging, the alloy is slow cooled down to room temperature by putting it at room temperature for example.

If the cooling rate is more than 15 deg. C./second, the residual internal stress due to the forging increases and it becomes difficult to improve the fatigue strength. If the cooling rate is less than 1 deg. C./second, coarsening of beta phase is furthered, and the tensile strength and toughness are liable to decrease.

Therefore, the cooling rate (deg. C./second) is preferably set in the range of not less than 1, preferably more than 3, more preferably more than 5, but not more than 15, preferably less than 12.

In order to avoid undesirable decrease in the tensile strength, it is preferable that the mean particle size of beta crystal grain is kept in the range of at most 50 micrometer after cool down and even in the finished club head.

In this view too, Ti-15V-6Cr-4Al and Ti-15Mo-5Zr-3Al are preferred because the mean particle size is small.

In order to prevent the alloy's surface from being covered by oxide film, the slow cooling process is preferably made by putting the alloy in controlled atmosphere such as inert gas or low activity of gas.

After cooling down, the face plate 1A is welded to the head main body 1B. In order that the already optimized crystal structure of the face plate 1A is not altered by the heat during welding, the formation of the above-mentioned turnback 12 is effectual because it can distance the welding part from the club face. The turnback 12 may be modified for example by forming the crown-side turnback 12*a* only or the sole-side turnback 12*b* only. Further, all the turnback may be omitted so that the face plate becomes almost flat. But, it is preferable that at least the crown-side turnback 12*a* and sole-side turnback 12*b* are formed not to alter the crystal structure in the face portion.

As to the head main body 1B, it may be modified into a two-or-more-piece structure wherein the metal parts are united by welding for example. In such a case, metal parts of different materials may be used.

Comparison Test I

From a 18 mm Dia. round bar of a beta titanium alloy Ti-15V-6Cr-4Al (mass percentage: v=15.20, Cr=5.98, Al=4.00, Fe=0.10, O=0.14, Ti=remainder), rectangular plates of 150 mm×20 mm each having a constant thickness (2.5, 2.7 or 3.2 mm) were made as test pieces by hot forging under the same conditions and then cooling under different conditions as shown in Table 1 to compare each other with respect to the fatigue strength against bending.

The fatigue strength of each test piece was evaluated as follow: a vertical load of 1200 MPa was repeatedly applied to a middle point of the test piece horizontally supported at two points (span=30 mm) one on each side of the middle point; and the number of application of load until the test piece was broken was counted as the fatigue strength. The results are indicated in Table 1 by an index based on Test piece No. 4 being 100, wherein the larger the index number, the higher the fatigue strength.

TABLE 1

| Test piece | 1 | 2 | 3 | 4 | 5 |
|---|---|---|---|---|---|
| Thickness (mm) | 2.7 | 2.5 | 2.7 | 2.7 | 3.2 |
| Cooling method | air cooling | air cooling | air cooling | air cooling | water-cooling |
| Cooling rate (deg. C./sec.) | 3 | 9 | 13 | over 20 | over 20 |
| Mean particle size of beta phase after cool down (micrometer) | 41.2 | 38.3 | 35.8 | 30.4 | 32.3 |
| Bending fatigue strength | 173 | 181 | 175 | 100 | 100 |

It was confirmed that the fatigue strength can be remarkably improved by slow cooling as shown by the test pieces 1, 2 and 3.

Comparison Test II

Using the above-mentioned beta titanium alloy Ti-15V-6Cr-4Al, face plates with turnback shown in FIG. 2 were made under different conditions as explained above, and they were welded to the identical head main bodies shown in FIG. 2 molded as a casting of Ti-6Al-4V and wood-type golf club heads (#1 driver) having a head volume of 380 cc were made. Using those metal wood heads, the following tests were conducted.

Restitution Coefficient Test

According to the "Procedure for Measuring the Velocity Ratio of a Club Head for conformance to Rule 4-1e, Appendix II, Revision 2 (Feb. 8, 1999), United States Golf Association", the restitution coefficient (e) of each club head was obtained. The results are shown in Table 2. The larger the value, the better the rebound performance.

Durability Test

The club head was attached to a FRP shaft to make a 45-inch wood club, and the golf club was mounted on a swing robot. The club head struck two-piece balls at a head speed of 50 meter/second repeatedly up to 5000 times and the number of hitting times until any damage was caused in the face portion was counted. The results are shown in Table 2.

TABLE 2

| Club head | Ex. 1 | Ex. 2 | Ex. 3 | Ref. 1 | Ref. 2 |
|---|---|---|---|---|---|
| Face portion | | | | | |
| Cooling method | air cooling | air cooling | air cooling | water-cooling | water-cooling |
| Cooling rate (deg. C./sec.) | 3 | 9 | 13 | over 20 | over 20 |
| Max. thickness (mm) | 2.7 | 2.5 | 2.7 | 2.7 | 3.2 |
| Mean particle size of beta phase after cool down (micrometer) | 41.2 | 38.3 | 35.8 | 30.4 | 32.3 |
| Restitution coefficient | 0.866 | 0.864 | 0.863 | 0.864 | 0.829 |
| Durability *1 | OK | OK | OK | broken at 3800 | OK |

*1) OK: There was no damage after 5000 hits

Comparison Test III

Using another beta titanium alloy Ti-15Mo-5Zr-3Al instead of the above-mentioned Ti-15V-6Cr-4Al, the same tests as in comparison Test I, II were made. The test results are shown in Table 3.

TABLE 3

| Club head | Ex. 4 | Ref. 3 |
|---|---|---|
| Face portion | | |
| Cooling method | air cooling | water-cooling |
| Cooling rate (deg. C./sec.) | 9 | over 20 |
| Max. thickness (mm) | 2.7 | 2.7 |
| Mean particle size of beta phase after cool down (micrometer) | 2.1 | 1.4 |
| Restitution coefficient | 0.861 | 0.86 |
| Durability *1 | OK | broken at 4020 |
| Bending fatigue strength | 153 | 99 |

From the test results, it was confirmed that the durability can be improved without deteriorating the rebound performance.

As explained above, in the present invention, as the face plate is increased in the fatigue strength, the face portion can be decreased in the thickness without lowering the durability. As a result, the rebound performance can be improved. Such effect will be maximized when Ti-15V-6Cr-4Al is used.

The present invention is suitably applied to wood-type golf club heads, but it can be also applied to iron-type, patter-type and utility-type club heads.

The invention claimed is:

1. A method of manufacturing a golf club head made up of at least two components including a face plate, the method comprising the following steps:

hot forging a material of a beta titanium alloy into the face plate having a maximum thickness of 20–2.7 mm, slow cooling the forged face plate at a rate of no more than 15 deg. C./second, and assembling a golf club head from the face plate and the remainder of said at least two components.

2. The method of manufacturing a golf club head according to claim 1, wherein the beta titanium alloy is selected from the group consisting of Ti-15V-6Cr-4Al and Ti-15Mo-5Zr-3Al.

3. The method of manufacturing a golf club head according to claim 1 or 2, wherein the forging temperature of the material during hot forging is in a range from 800 to 950 deg. C.

4. The method of manufacturing a golf club head according to claim 1 or 2, wherein the mean particle size of beta crystal grain in the face plate is at most 50 micrometers after the slow cooling is done.

5. A method of manufacturing a golf club head made up of components including a face plate, the method comprising:

hot forging a material of a beta titanium alloy into the face plate, wherein the forging temperature of the material during hot forging is in a range from 800 to 950 deg. C.;

slow cooling the forged face plate after the hot forging, wherein the rate of the slow cooling is no more than 15 deg. C./second; and assembling a golf club head from said components including the face plate.

6. The method of manufacturing a golf dub head according to claim 5, wherein the mean particle size of beta crystal grain in the face plate is at most 50 micrometers after the slow cooling is done.

7. The method of manufacturing a golf club head according to claim 5, wherein said beta titanium alloy is Ti-15V-6Cr-4Al.

8. The method of manufacturing a golf club head according to claim 5, wherein said components include a main body made of at least one metal material, and the assembling of the head includes a step of welding said face plate to the main body.

9. The method of manufacturing a golf club head according to claim 8, wherein said face plate is provided with a turnback extending backward to be welded to the main body.

10. The method of manufacturing a golf club head according to claim 5, wherein the golf club head is a wood-type hollow head, said components include a hollow main body made of at least one metal material, and said face plate is provided with a turnback extending backward, and the assembling of the head includes a step of welding the turnback to the main body.

* * * * *